US006779501B2

(12) United States Patent
Simpson et al.

(10) Patent No.: US 6,779,501 B2
(45) Date of Patent: Aug. 24, 2004

(54) METHOD TO REDUCE ROTATIONAL OSCILLATION OF A VANE STYLE PHASER WITH A CENTER MOUNTED SPOOL VALVE

(75) Inventors: Roger Simpson, Ithaca, NY (US); Franklin R. Smith, Cortland, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/461,539

(22) Filed: Jun. 12, 2003

(65) Prior Publication Data

US 2003/0230269 A1 Dec. 18, 2003

Related U.S. Application Data

(60) Provisional application No. 60/388,985, filed on Jun. 14, 2002.

(51) Int. Cl.[7] ..... F01L 1/34

(52) U.S. Cl. ..... 123/90.17; 123/90.15; 123/90.16

(58) Field of Search ..... 123/90.15, 90.16, 123/90.17, 90.18; 464/1, 2, 160

(56) References Cited

U.S. PATENT DOCUMENTS

| | | | | |
|---|---|---|---|---|
| 5,002,023 A | | 3/1991 | Butterfield et al. | 123/90.15 |
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,361,735 A | | 11/1994 | Butterfield et al. | 123/90.17 |
| 5,497,738 A | | 3/1996 | Siemon et al. | 123/90.17 |
| 5,878,782 A | * | 3/1999 | Nakajima | 137/625.65 |
| 6,250,265 B1 | | 6/2001 | Simpson | 123/90.17 |
| 6,477,996 B2 | * | 11/2002 | Ogawa | 123/90.15 |

* cited by examiner

*Primary Examiner*—Thomas Denion
*Assistant Examiner*—Ching Chang
(74) *Attorney, Agent, or Firm*—Brown & Michaels, PC; Greg Dziegielewski

(57) ABSTRACT

A phaser for an internal combustion engine having at least one camshaft. The phaser has a housing and a rotor. The housing has an outer circumference for accepting a drive force and the rotor connects to a camshaft coaxially located within the housing. The housing and the rotor define at least one vane separating chambers, advance and retard. The vane shifts the relative angular position of the housing and the rotor. The phaser also includes a spool valve comprising a spool slidably mounted within in a bore in the rotor. The spool routes operating fluid from a supply of pressurized fluid to the chambers. At least one passage from the supply to the chambers provides makeup fluid. The passage includes a check valve and a restrictor.

31 Claims, 7 Drawing Sheets

METHOD TO REDUCE ROTATIONAL OSCILLATION OF A VANE STYLE PHASER WITH A CENTER MOUNTED SPOOL VALVE

REFERENCE TO RELATED APPLICATIONS

This application claims an invention, which was disclosed in Provisional application Ser. No. 60/388,985, filed Jun. 14, 2002, entitled "Method To Reduce Rotational Oscillation Of A Vane Style Phaser With A Center Mounted Spool Valve". The benefit under 35 USC § 119(e) of the United States provisional application is hereby claimed, and the aforementioned application is hereby incorporated herein by reference.

BACKGROUND OF THE INVENTION

1. Field of the Invention

The invention pertains to the field of variable cam timing systems. More particularly, the invention pertains to a method of reducing rotational oscillation of a vane style phaser with a center mounted spool valve.

2. Description of Related Art

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor with one or more vanes, mounted to the end of the camshaft, surrounded by a housing with the vane chambers into which the vanes fit. It is possible to have the vanes mounted to the housing, and the chambers in the rotor, as well. The housing's outer circumference forms the sprocket, pulley or gear accepting drive force through a chain, belt or gears, usually from the camshaft, or possibly from another camshaft in a multiple-cam engine.

Since the phasers cannot be perfectly sealed they are subject to oil loss through leakage, especially in vane phasers that use the conventional four-way valves mounted in the valve body to control the phaser. Four-way valves have a supply and a return port and at least two ports, which go to the load, or in the case of the phaser, to the advance and retard chambers. The number of lands on the spool may vary depending on need. Typically, the four-way valve is remotely located and has many leak paths that can cause the phaser to move back and forth in reaction to the torsionals of the camshaft. Because the phaser is not 100% sealed and prone to leakage the four-way valve must have an open null position to makeup for the oil that has leaked from either the advance or retard chamber. The open-null position allows oil to leak into the inlet lines leading to the advance and retard chambers. In turn, the open null position of the four-way valve also increases the positional oscillation of the camshaft due to the additional leak now present between the advance and retard chambers.

In response to the increased amount of leakage that occurs with the use of a conventional four-way valve remotely, the four-way valve has been moved to the center of the phaser, which is conventionally in the rotor, but may be elsewhere. By moving the four-way valve (spool valve) to the center of the rotor many of the leaks paths that were originally present such as the cam bearing, the nose oil feed bearing, and the spool housing to engine block interference are eliminated. The main sources of leakage that are still present are from chamber to chamber, chamber to atmosphere and across the spool in particular at the open null position. Modifying the spool valve to a closed null design could further reduce leakage. However, if the null oil flow is completely shut off, the oil that does leak out of the rotor increases the positional oscillations that take place. Therefore, there is a need in the art to reduce the leak paths, preferably by using a closed null spool design, and provide makeup oil to the chambers of the phaser to reduce positional oscillation via some other means.

SUMMARY OF THE INVENTION

A phaser for an internal combustion engine having at least one camshaft. The phaser has a housing and a rotor. The housing has an outer circumference for accepting a drive force and the rotor connects to a camshaft coaxially located within the housing. The housing and the rotor define at least one vane separating chambers, advance and retard. The vane shifts the relative angular position of the housing and the rotor. The phaser also includes a spool valve comprising a spool slidably mounted within in a bore in the rotor. The spool routes operating fluid from a supply of pressurized fluid to the chambers. At least one passage from the supply to the chambers provides makeup fluid. The passage includes a check valve and a restrictor.

DETAILED DESCRIPTION OF THE INVENTION

In a variable cam timing (VCT) system, the timing gear or sprocket on the camshaft is replaced by a variable angle coupling known as a "phaser", having a rotor connected to the camshaft and a housing connected to (or forming) the timing gear, which allows the camshaft to rotate independently of the timing gear, within angular limits, to change the relative timing of the camshaft and crankshaft. The term "phaser", as used here, includes the housing and the rotor, and all of the parts to control the relative angular position of the housing and rotor, to allow the timing of the camshaft to be offset from the crankshaft. In the multiple-camshaft engine, it will be understood that there could be one phaser on each camshaft, as is known to the art.

In oil pressure actuated (OPA) or torsion assist or torque actuated (TA) phasers, the engine oil pressure is applied to one side of the vane or the other, in the retard or advance chamber, to move the vane. In TA phasers a check valve is added, either in supply lines to the chambers, or in the engine oil supply line to the spool valve. The check valve blocks oil pressure pulses due to torque reversals from propagating back into the oil system, and stop the vane from moving backward due to torque reversals. Motion of the vane due to forward torque effects is permitted.

As shown in the figures of the present invention, the spool (104) of the spool valve (109) is located within the rotor.

Figure 5:
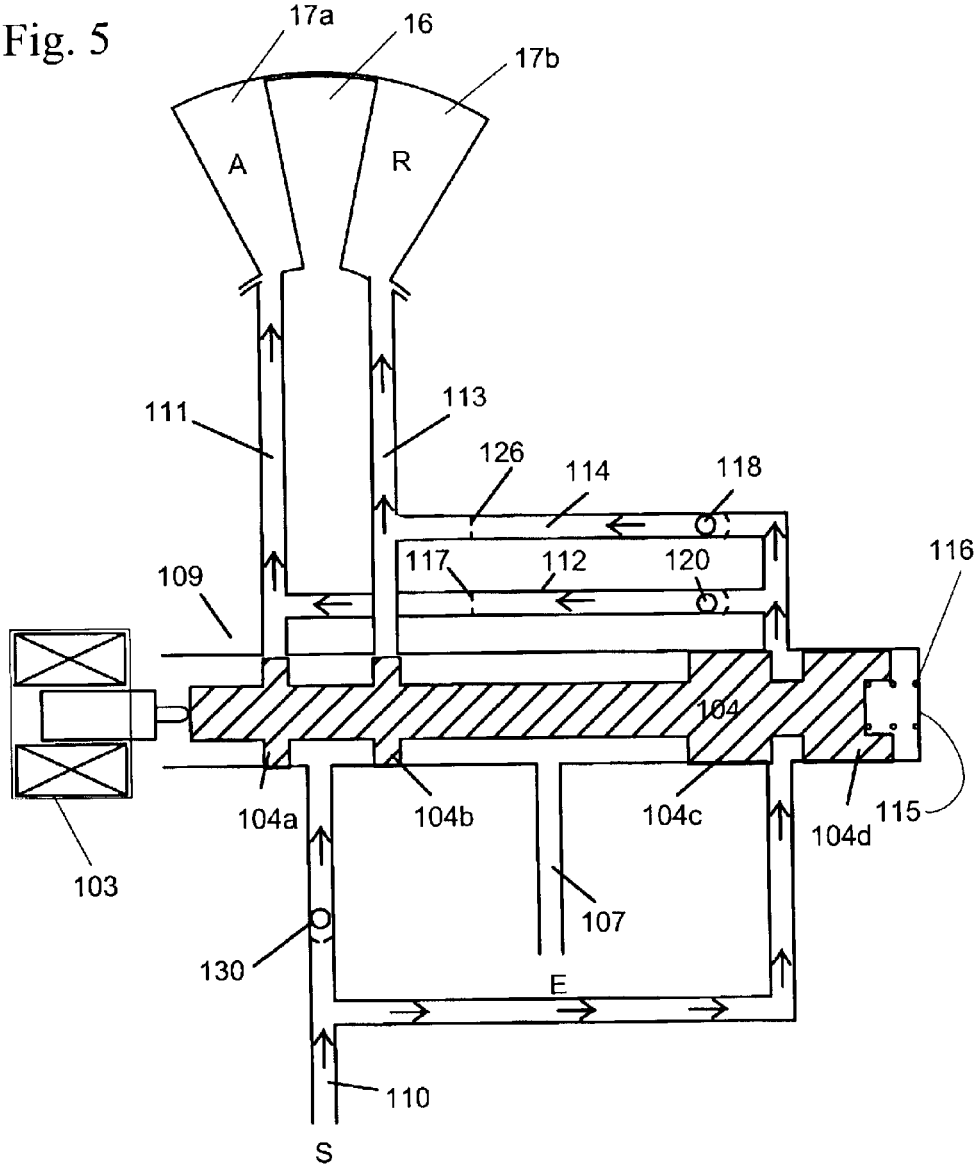
FIG. 5 shows a schematic of an alternative phaser at null position.

Passageways (111) and (113) lead oil from the spool valve (109) to the chambers (17*a*)(17*b*). Since the spool valve (109), is in the rotor and not the camshaft, the camshaft is much easier to manufacture. Externally mounted valves and elaborate passages do not need to be machined into the camshaft, since fluid only needs to travel through the phaser into the spool valve (109) which is in the rotor. Therefore, having the spool valve (109) in the rotor reduces leakage and improves the response of the phaser. Alternatively, the spool valve may be located in the housing. Note that the spool valve represented in FIGS. 1, 2, and 5 are different.

Figure 1:
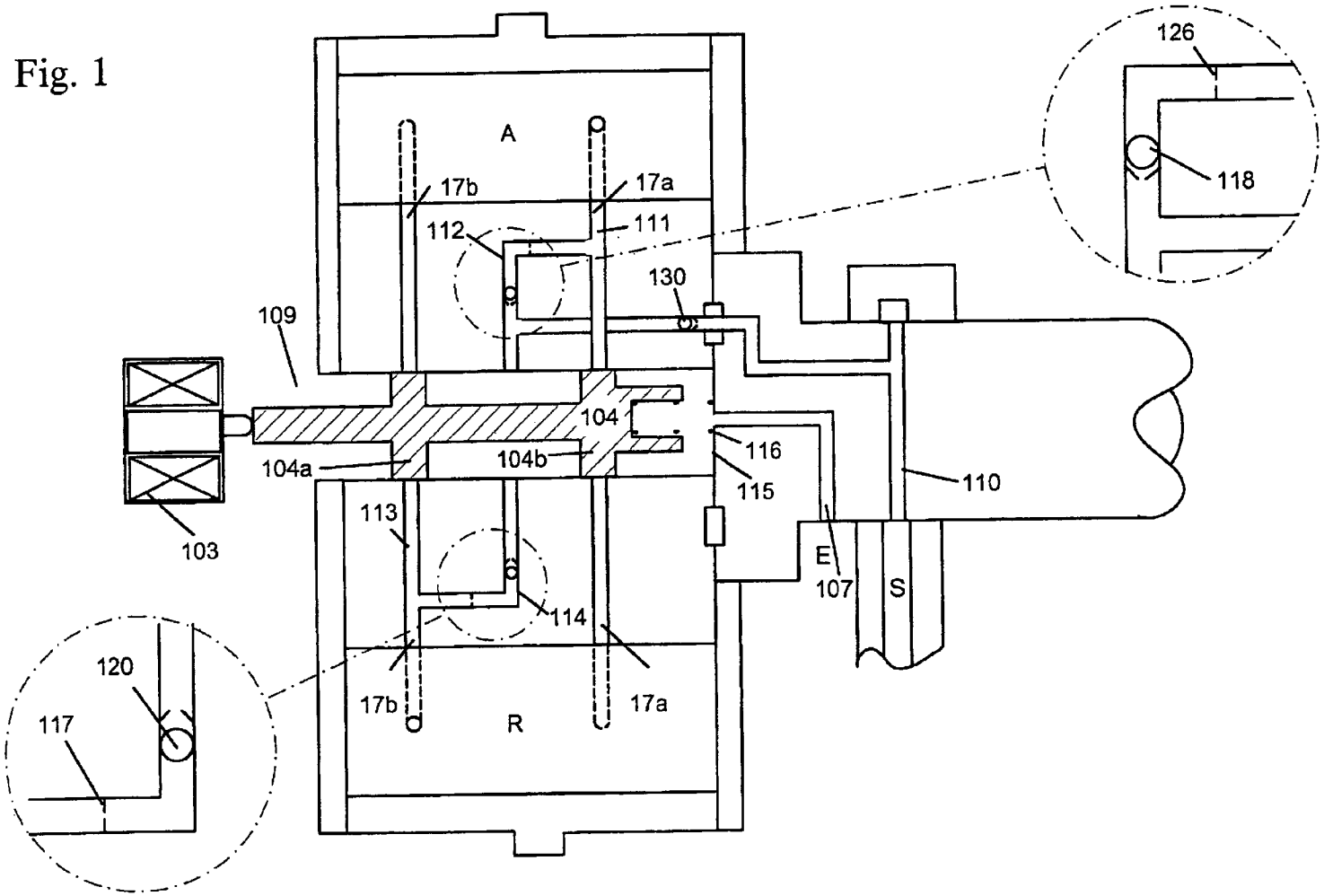
FIG. 1 shows a sectional view of the present invention.
Figure 2:
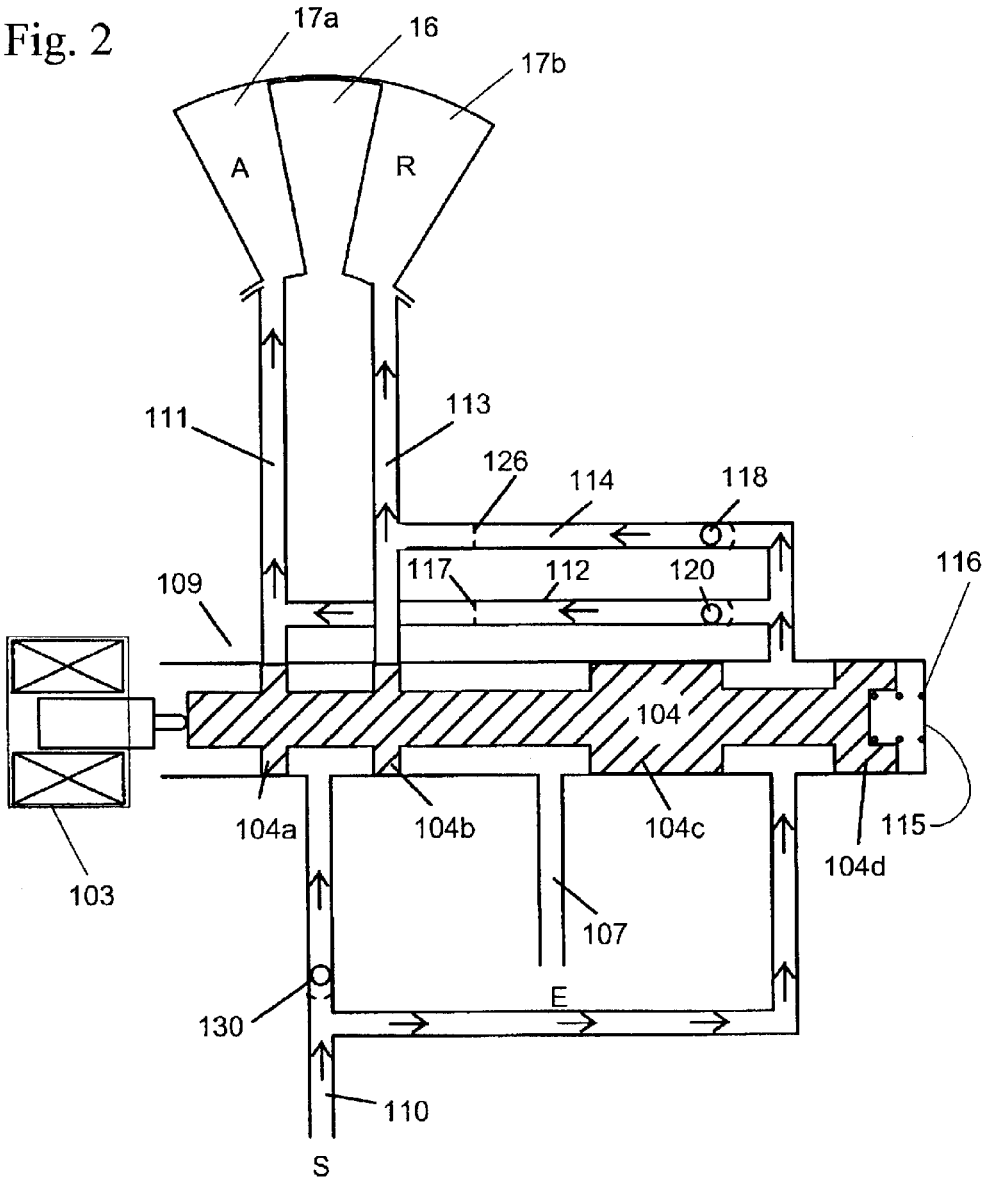
FIG. 2 shows a schematic of the phaser at null position.

FIGS. 1 and 2 shows the null position of a torsion assist (TA) phaser. The phaser operating fluid or hydraulic fluid (122), illustratively in the form of engine lubricating oil, flows into chambers (17*a*) (labeled "A" for "advance") and (17*b*) (labeled "R" for "retard"). Oil is introduced into the phaser by way of a common inlet line (110) through the inlet check valve (130). The spool valve (109) is made up of a spool (104) and a cylindrical member (115). The spool (104) is slidable back and forth and includes spool lands (104*a*) and (104*b*), as shown in FIG. 1, and (104*c*) and (104*d*) as shown in FIG. 2, which fit snugly in cylindrical member (115). As shown in the figures, supply oil is moved through cylindrical member (115) between spool lands (104*a*) and (104*b*). Supply oil is moved to passages (112) and (114), possibly through the unswitchable area of the cylindrical member (115), as shown in FIG. 2 or through the area of land (104*a*) as shown in FIG. 1.

To maintain a phase angle, the spool (104) is positioned at null, as shown in FIGS. 1 and 2. When the spool (104) is in the null position, spool lands (104*a*) and (104*b*) overlap and block both of the inlet lines (111) and (113). However, there is inevitably leakage from the chambers (17*a*) and (17*b*). Makeup fluid is supplied via lines (112) and (114), connected to inlet lines (111) and (113) respectively. Within the intermediary lines (112) and (114) are check valves (118) and (120) along with restrictors (117) and (126). The restrictors (117) and (126) in the intermediary lines (112) and (114) allow continuous makeup fluid to flow into the phaser through the inlet check valves (118) and (120) and limit the loss of fluid when the spool valve is moved off the null position exposing either line 112 or line 114 to an exhaust port. The check valves (118) and (120) block the flow of hydraulic fluid (122) out of the chambers (17*a*) and (17*b*) and the inlet lines (111) and (113) to the supply (110). The check valves (118) and (120) allow the flow of hydraulic fluid in for makeup oil, keeping the chambers full of oil, preventing back drive motion and positional oscillation.

Figure 3:
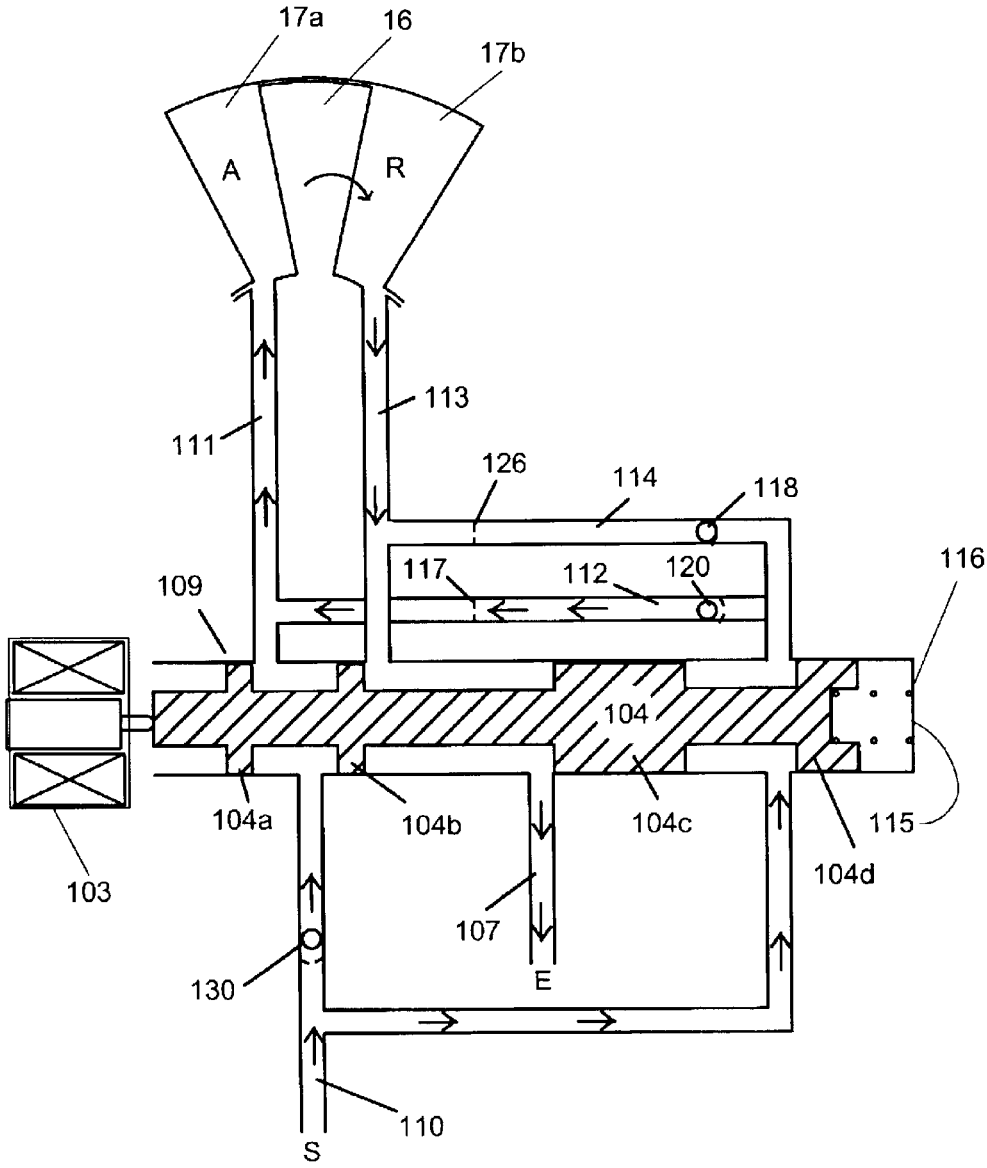
FIG. 3 shows a schematic of the phaser at full open advance.

FIG. 3 shows the TA phaser in the full open advance position. Oil is introduced into the phaser by way of common inlet line (110) and check valve (130). When the spool valve (104) is moved to the left (as shown in the figure), the two lands (104*a*) and (104*b*) are not blocking either of the inlet lines (111) and (113). The oil flows unrestricted from the spool valve into inlet line (111), which leads to chamber (17*a*) (labeled "A" for "advance"). During cam torque reversals the check valve (130) blocks flow of oil out of line (111) to supply line (110). The oil flowing into line (111) moves the vane (16) in the direction of the arrow causing the oil present in the retard chamber (17*b*) (labeled "R" for "retard") to exit the chamber through inlet line (113), and exit the phaser through exhaust port (107). When spool land (104*b*) opens line (113) to exhaust port (107) it also opens line (114) to exhaust port (107), which allows source oil to flow from line (110) through line (114) out the exhaust port (107). Restrictor (126) in line (114) limits the amount of oil that will flow directly from line (114) out the exhaust port (107). Under certain conditions, the pressure in line (113) and line (114) will be great enough to close check valve (118) and prevent oil from flowing through line (114) out the exhaust port (107). Under all other conditions the restrictor (126) will limit the amount of oil that can flow from line (114) out the exhaust port (107).

Figure 4:
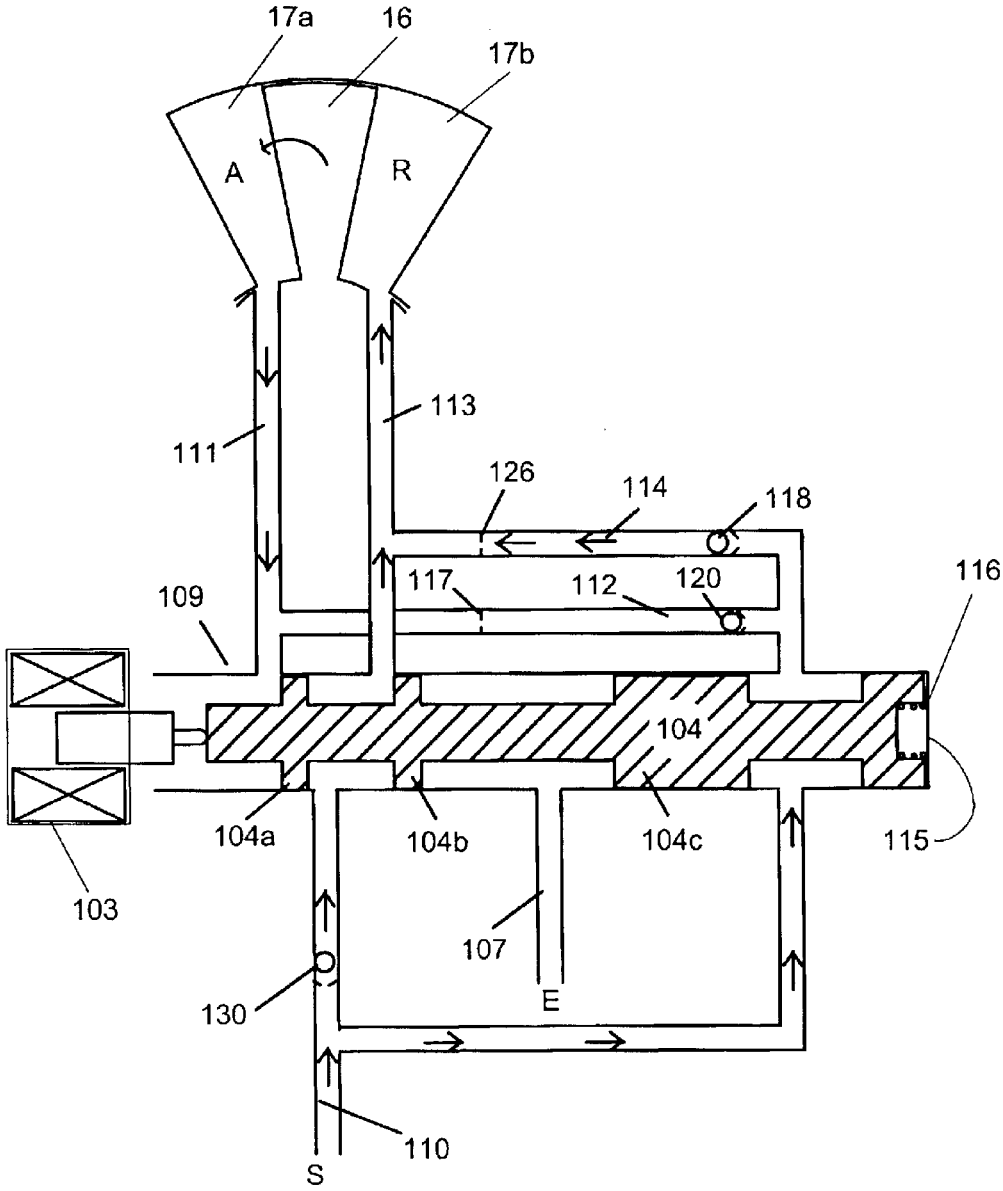
FIG. 4 shows a schematic of the phaser at full open retard.

FIG. 4 shows the TA phaser in the full open retard position. Oil is introduced into the phaser by way of common inlet line (110) and check valve (130). Moving the spool valve (104) to the right (as shown in the figure) causes the two lands (104*a*) and (104*b*) to open flow passages (111) and (113). The oil flows unrestricted from the spool valve into inlet line (113), which leads to chamber (17*b*) (labeled "r" for "retard"). During cam torque reversals the check valve (130) blocks flow of oil out of line (113) to supply line (110). The oil flowing into line (113) moves the vane (16) in the direction of the arrow causing the oil present in the advance chamber (17*a*) (labeled "a" for "advance") to exit the chamber through line (111) and exit the phaser in front of spool (109). When spool land (104*a*) opens line (111) to exhaust out the front of the spool (109) it also opens line (112) to exhaust, which allows source oil to flow from line (110) through line (112) out the exhaust. Restrictor (117) in line (112) limits the amount of oil that will flow directly from line (112) out the exhaust.

In an alternate embodiment, shown in FIG. 5, a torsion assist (TA) phaser is in the null position. The phaser operating fluid or hydraulic fluid (122), illustratively in the form of engine lubricating oil, flows into chambers (17*a*) (labeled "A" for "advance") and (17*b*) (labeled "R" for "retard"). Oil is introduced into the phaser by way of a common inlet line (110) and check valve (130). The spool valve (109) is made up of a spool (104) and a cylindrical member (115). The spool (104) is slidable back and forth and includes spool lands (104*a*), (104*b*), (104*c*), and (104*d*) as shown in FIG. 5, which fit snugly in cylindrical member (115). As shown in the figure, supply oil is moved through cylindrical member (115) between spool lands (104*a*) and (104*b*). Supply oil is moved to passages (112) and (114), through an area of the cylindrical member (115) that is varied by the spool (104) of the spool valve (109).

To maintain a phase angle, the spool (104) is positioned at null, as shown in FIG. 5. When the spool (104) is in the null position, spool lands (104*a*) and (104*b*) overlap and block both of the inlet lines (111) and (113). However, there is inevitably leakage from the chambers (17*a*) and (17*b*). Makeup fluid is supplied via lines (112) and (114), connected to inlet lines (111) and (113) respectively. Within the intermediary lines (112) and (114) are check valves (118) and (120) along with restrictors (117) and (126). The restrictors (117) and (126) in the intermediary lines (112) and (114) allow continuous makeup fluid to flow into the phaser through the inlet check valves (118) and (120) and limit the loss of fluid when the spool valve is moved off of null position. The check valves (118) and (120) block the flow of hydraulic fluid (122) out of the chambers (17*a*) and (17*b*) and the inlet lines (111) and (113) to the supply (110). The check valves (118) and (120) allow the flow of hydraulic fluid in for makeup oil, keeping the chambers full of oil, preventing back drive motion and positional oscillation.

Figure 6:
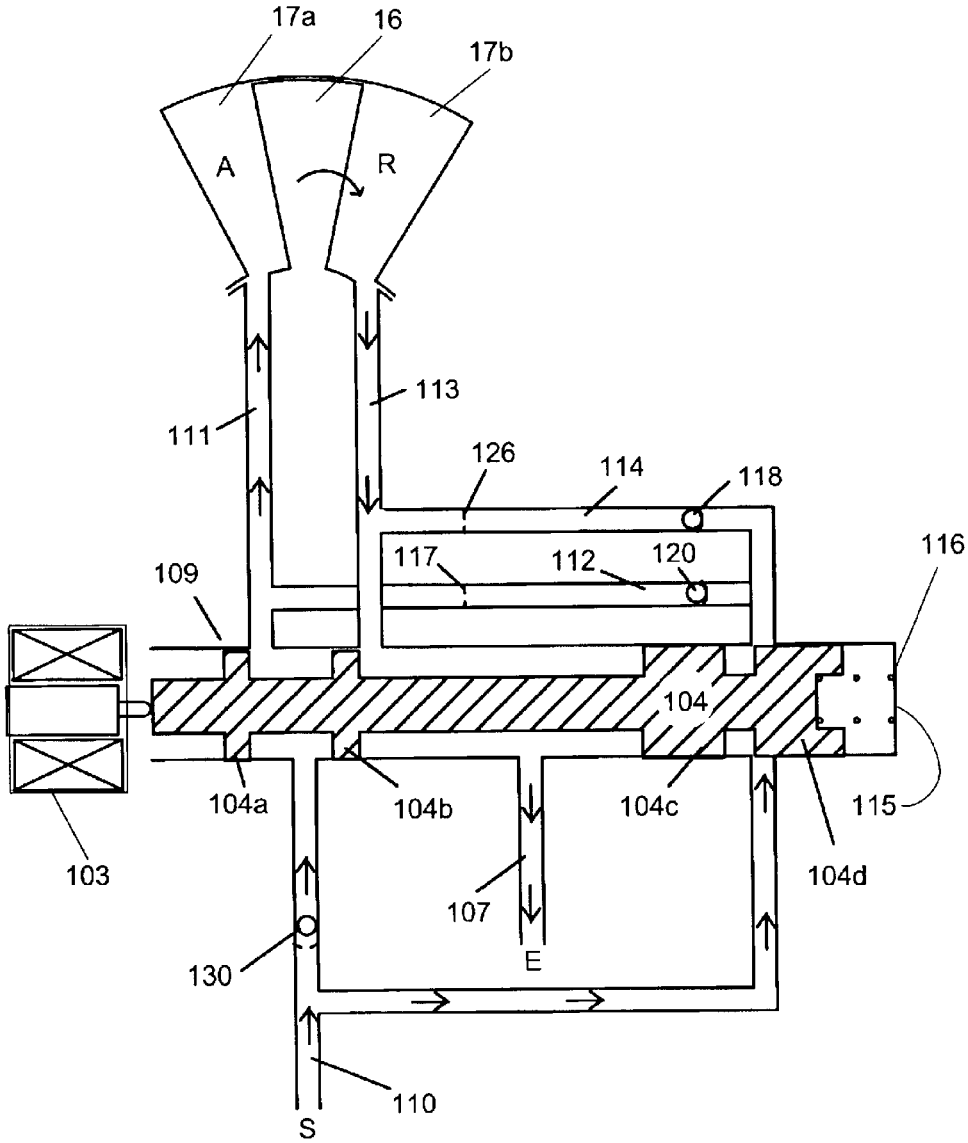
FIG. 6 shows a schematic of an alternative phaser at full open advance.

FIG. 6 shows the alternate TA phaser in the full open advance position. Oil is introduced into the phaser by way of common inlet line (110) and check valve (130). When the spool (104) is moved to the left (as shown in the figure) the two lands (104*a*), (104*b*) are not blocking either of the inlet lines (111) and (113). The oil flows unrestricted from the spool valve into inlet line (111), which leads to chamber (17*a*) (labeled "A" for "advance"). During cam torque reversals the check valve (130) blocks flow of oil out of line (111) to supply line (110). The oil flowing into line (111) moves the vane (16) in the direction of the arrow causing the oil present in the retard chamber (17*b*) (labeled "R" for "retard") to exit the chamber through inlet line (113), and exit the phaser through exhaust port (107). Unlike the previous embodiment, no additional fluid is supplied to inlet line (113) as both intermediary lines (112) and (114) are blocked by spool land (104*d*). Therefore source oil (122) does not flow from line (110) through line (114) and out the exhaust port (107). If the restriction from spool land (104*d*) is sufficient then restrictor (126) would not be necessary and could be removed from line (114).

Figure 7:
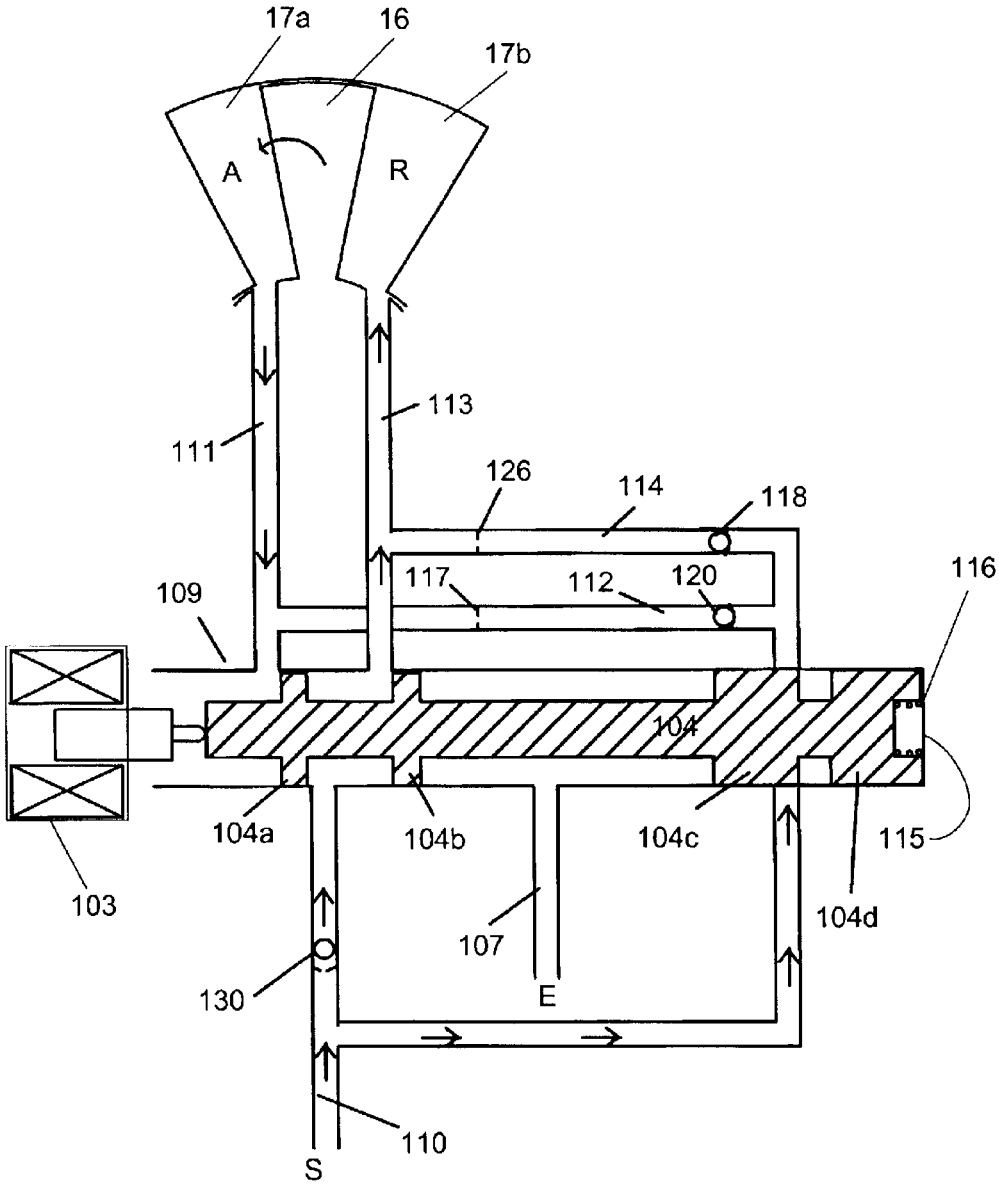
FIG. 7 shows a schematic of an alternative phaser at full open retard.

FIG. 7 shows the alternate TA phaser in a full open retard position. Oil is introduced into the phaser by way of common inlet line (110) and check valve (130). When the spool valve (104) is moved to the right (as shown in the figure) the two lands (104*a*) and (104*b*) are not blocking either of the inlet line (111) and (113). The oil flows unrestricted from the spool valve into inlet line (113), which leads to chamber (17*b*) (labeled "R" for "retard"). During cam torque reversals the check valve (130) blocks flow of oil out of line (113) to supply line (110). The oil moves the vane (16) in the direction of the arrow causing the oil present in the advance chamber (17*a*) (labeled "A" for "advance) to exit the chamber through inlet line (111) and exit the phaser out the front of the spool valve (109). Unlike in the previous embodiment, no additional fluid is supplied to inlet line (111) from intermediary line (112), as the intermediary lines (112) and (114) are blocked by the spool land (104*c*). Therefore source oil (122) does not flow from line (110) through line (112) and out the exhaust in front of the spool. If the restriction from spool land (104*c*) is sufficient then restrictor (117) would not be necessary and could be removed from line (112).

This invention is equally applicable to oil pressure actuated (OPA) type phasers as well as Torsion Assist (TA) style phasers. The OPA schematics could be created by simply removing check valve (130) from FIGS. 1–7.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A phaser for limiting leakage across a plurality of chambers for an internal combustion engine having at least one camshaft comprising:

a housing having an outer circumference for accepting drive force;

a rotor for connection to a camshaft coaxially located within the housing;

the housing and the rotor defining at least one vane separating the plurality of chambers, the vane being capable of rotation to shift the relative angular position of the housing and the rotor, a spool valve comprising a spool having a plurality of lands slidably mounted within in a bore in the rotor, the spool slidable to route operating fluid from a supply of pressurized fluid to the chambers; and at least one passage from the supply to the chambers for providing makeup fluid, wherein the passage contains a check valve and a restrictor.

2. The phaser of claim 1, wherein each of the chambers has a separate passage for providing makeup oil.

3. The phaser of claim 2, wherein the separate passages to each chamber have a check valve and a restrictor.

4. The phaser of claim 3, wherein the check valve and the restrictor only allow operating fluid into the plurality of chambers.

5. The phaser of claim 3, wherein the restrictor restricts the loss of operating fluid from the phaser when a phase angle is no longer maintained.

6. The phaser of claim 1, wherein makeup fluid is routed through an unswitchable portion of the bore.

7. The phaser of claim 1, wherein makeup fluid is routed through a switchable portion of the bore.

8. The phaser of claim 1, wherein the phaser is oil pressure actuated.

9. The phaser of claim 1, wherein the phaser is torsion assist.

10. The phaser of claim 1, wherein when the spool is in a null position, the spool limits leakage from chamber to chamber such that oscillation of the phaser is limited.

11. A phaser for limiting leakage across a plurality of chambers for an internal combustion engine having at least one camshaft comprising:

a housing having an outer circumference for accepting drive force;

a rotor for connection to a camshaft coaxially located within the housing;

the housing and the rotor defining at least one vane separating the plurality of chambers, the vane being capable of rotation to shift the relative angular position of the housing and the rotor, wherein when the housing and the rotor are fixed relative to each other they maintain a phase angle;

a spool valve comprising a spool having a plurality of lands slidably mounted within in a bore in the rotor, the spool slidable to route operating fluid from a supply of pressurized fluid to the chambers, wherein at least two of the plurality of lands prevent operating fluid from the supply to the chambers when the housing and rotor are fixed relative to each other; and at least one passage from the supply to the chambers for providing makeup fluid, wherein the passage contains a check valve and a restrictor.

12. The phaser of claim 11 wherein each of the chambers has a separate passage for providing makeup oil.

13. The phaser of claim 12, wherein the separate passages to each chamber have a check valve and a restrictor.

14. The phaser of claim 13, wherein the check valve and the restrictor only allow operating fluid into the plurality of chambers.

15. The phaser of claim 13, wherein the restrictor restricts the loss of operating fluid from the phaser when a phase angle is no longer maintained.

16. The phaser of claim 11, wherein makeup fluid is routed through an unswitchable portion of the bore.

17. The phaser of claim 11, wherein makeup fluid is routed through a switchable portion of the bore.

18. The phaser of claim 11, wherein the phaser is oil pressure actuated.

19. The phaser of claim 11, wherein the phaser is torsion assist.

20. The phaser of claim 11, wherein when the spool is in a null position, the spool limits leakage from chamber to chamber such that oscillation of the phaser is limited.

21. An improved phaser for limiting leakage across a plurality of chambers for an internal combustion engine having at least one camshaft a housing having an outer circumference for accepting drive force; a rotor for connection to a camshaft coaxially located within the housing, the housing and the rotor defining at least one vane separating a plurality of chambers, the vane being capable of rotation to shift the relative angular position of the housing and the rotor, a spool valve comprising a spool with a plurality of lands slidably mounted within in a bore in the rotor, the spool slidable to route operating fluid from a supply of pressurized fluid to the chambers, the improvement comprising:

at least one passage from the supply line to the chambers for providing makeup fluid, wherein the passage contains a check valve and a restrictor.

22. The improved phaser of claim 21, wherein each of the chambers has a separate passage for providing makeup oil.

23. The improved phaser of claim 22, wherein the separate passages to each chamber have a check valve and a restrictor.

24. The improved phaser of claim 23, wherein the check valve and the restrictor only allow operating fluid into the plurality of chambers.

25. The improved phaser of claim 23, wherein the restrictor restricts the loss of operating fluid from the phaser when a phaser angle is no longer maintained.

26. The improved phaser of claim 21, wherein makeup fluid is routed through an unswitchable portion of the bore.

27. The improved phaser of claim 21, wherein makeup fluid is routed through a switchable portion of the bore.

28. The improved phaser of claim 21, wherein the phaser is oil pressure actuated.

29. The improved phaser of claim 21, wherein the phaser is torsion assist.

30. The phaser of claim 21, wherein when the spool is in a null position, the spool limits leakage from chamber to chamber such that oscillation of the phaser is limited.

31. A method of operating a phaser for limiting leakage across a plurality of chambers for an internal combustion engine having at least one camshaft a housing having an outer circumference for accepting drive force; a rotor for connection to a camshaft coaxially located within the housing, the housing and the rotor defining at least one vane separating a plurality of chambers, the vane being capable of rotation to shift the relative angular position of the housing and the rotor, a spool valve comprising a spool with a plurality of lands slidably mounted within in a bore in the rotor, the spool slidable to route operating fluid from a supply of pressurized fluid to the chambers, the steps comprising:

moving the phaser to a first null position by fixing the housing relative to a rotor to maintain a phase angle, such that the spool with the plurality of lands prevents operating fluid from entering the plurality of chambers, limiting leakage from chamber to chamber such that oscillation of the phaser is limited; and moving the phaser to a second non-null position by moving the housing relative to the rotor, such that the spool with the plurality of lands allows operating fluid to enter the plurality of chambers through at least one passage from the supply line to the chambers for providing makeup fluid, wherein the passage contains a check valve and a restrictor, such that the restrictor restricts the loss of operating fluid from the phaser when the phaser is the non-null position.

* * * * *